US011844387B2

(12) United States Patent
Endale

(10) Patent No.: US 11,844,387 B2
(45) Date of Patent: Dec. 19, 2023

(54) HEADWEAR ASSEMBLY

(71) Applicant: Zelalem Endale, Avon, MA (US)

(72) Inventor: Zelalem Endale, Avon, MA (US)

( * ) Notice: Subject to any disclaimer, the term of this patent is extended or adjusted under 35 U.S.C. 154(b) by 0 days.

(21) Appl. No.: 17/509,027

(22) Filed: Oct. 24, 2021

(65) Prior Publication Data

US 2022/0125146 A1 Apr. 28, 2022

Related U.S. Application Data

(60) Provisional application No. 63/104,869, filed on Oct. 23, 2020.

(51) Int. Cl.
*A42B 1/041* (2021.01)
*A41D 20/00* (2006.01)

(52) U.S. Cl.
CPC ..... *A42B 1/041* (2013.01); *A41D 20/00* (2013.01)

(58) Field of Classification Search
CPC ..... A41D 23/00; A41D 20/00; A42B 1/041; A42B 1/241; A42B 1/18; A45D 8/40
See application file for complete search history.

(56) References Cited

U.S. PATENT DOCUMENTS 2,160,567 A 5/1939 Sterne
4,481,681 A * 11/1984 Hankin ..... A41D 20/00 2/181
4,982,451 A 1/1991 Graham
5,146,630 A * 9/1992 Richard ..... A41D 20/005 2/171.2
5,161,260 A * 11/1992 Reynolds ..... A42B 1/0186 2/209.13
5,456,274 A * 10/1995 Selbee ..... A45D 8/36 132/275
5,467,743 A * 11/1995 Doose ..... A01K 27/006 119/858
5,594,956 A * 1/1997 Barrientos ..... A42B 1/22 2/172
5,640,721 A * 6/1997 Jackson ..... A41D 20/00 2/209.13
5,875,493 A * 3/1999 MacDonald ..... A42B 1/205 2/171.1
6,006,362 A 12/1999 Walsh
6,052,830 A * 4/2000 Payne ..... A42B 1/045 2/171.1
6,209,140 B1 * 4/2001 Ebeling ..... A01K 27/006 2/207
6,438,761 B1 * 8/2002 McGarrity ..... A42B 3/00 2/410
6,738,986 B1 5/2004 Martin
D543,013 S 5/2007 Robinson, III
(Continued)

FOREIGN PATENT DOCUMENTS

WO 1998031244 A1 7/1998

*Primary Examiner* — Jillian K Pierorazio
(74) *Attorney, Agent, or Firm* — Bold IP, PLLC

(57) ABSTRACT

A headwear assembly adapted to be used with a type of headwear commonly referred to as a durag (also referred to as a wave cap) is provided. The headwear assembly provides a padded layer between the durag's tie-ends and the wearer's forehead when worn with a strap that extends around the wearer's head to hold the headwear in place. A sleeve with a sleeve channel is configured with the padded layer to receive the durag's tie-ends and to hold them in secure.

18 Claims, 9 Drawing Sheets

(56) References Cited

U.S. PATENT DOCUMENTS

| | | | | |
|---|---|---|---|---|
| 9,265,323 | B1 | 2/2016 | Campbell | |
| 9,901,132 | B2 | 2/2018 | Hairston | |
| 10,076,150 | B1 * | 9/2018 | Flatt | A42C 5/02 |
| 2006/0179544 | A1 * | 8/2006 | Knievel | A42B 1/041 2/181 |
| 2007/0050887 | A1 * | 3/2007 | Leguenec | A42B 1/041 2/171 |
| 2007/0169249 | A1 * | 7/2007 | Leguenec | A42B 1/041 2/171.6 |
| 2008/0000012 | A1 * | 1/2008 | Adejare | A42B 1/041 2/171 |
| 2013/0185844 | A1 * | 7/2013 | Moore | A42B 1/241 2/209.13 |
| 2016/0219960 | A1 * | 8/2016 | Hairston | A42B 1/041 |
| 2019/0075874 | A1 | 3/2019 | Smith, Sr. et al. | |

* cited by examiner

HEADWEAR ASSEMBLY

CROSS-REFERENCE TO RELATED APPLICATIONS

This application claims priority to U.S. Provisional Application No. 63/104,869 filed Oct. 23, 2020, the entire contents of which are hereby fully incorporated herein by reference for all purposes.

FIELD OF THE INVENTION

This invention relates to headwear, including headwear to be worn with durags.

BACKGROUND

Durags, also referred to as wave caps, are a very popular type of headwear worn throughout the world. Not only is the wearing of a durag considered to be fashionable, but the utility of the durag to hold a hair style in place also is appealing.

As is known in the art, a durag is secured by placing it on one's head and wrapping its tie-ends, sometimes comprising strings, around the wearer's forehead, extending the tie-ends to the back of the head and tying them in place. While this procedure secures the durag in place, the portion of the tie-ends that extend across the wearer's forehead may often cause discomfort and/or indentations to the skin. In addition, the tie-ends may shift during use and require retying.

Accordingly, there is a need for a type of headwear that provides a cushion between the durag's tie-ends and the wearer's forehead, and that helps to secure the tie-ends in place.

SUMMARY

According to one aspect, one or more embodiments are provided below for an article of headwear for use with a durag, the article of headwear including a sleeve with a sleeve first end and a sleeve second end, a sleeve channel extending between the sleeve first end and the sleeve second end and configured to transition from an open position to a closed position, a strap with a strap first end and a strap second end, the strap first end attached to the sleeve first end and the strap second end attached to the sleeve second end, and at least one first releasable attachment mechanism configured with the sleeve and adapted to releasably secure the sleeve channel closed when the sleeve channel is in the closed position, wherein the sleeve channel is adapted to receive at least one durag tie-end when the article of headwear is placed on a wearer's head.

In another embodiment, the sleeve includes a back side adapted to face the wearer when the article of headwear is placed on the wearer's head, the article of headwear further comprising a pad coupled to the back side of the sleeve.

In another embodiment, the sleeve includes a top side and a bottom side, the top side and the bottom side extending between the sleeve first end and the sleeve second end, and wherein the sleeve channel is configured to open along the top side and/or along the bottom side when transitioning to the open position.

In another embodiment, the sleeve channel is adapted to receive the at least one durag tie-end through the top side and/or through the bottom side.

In another embodiment, the sleeve channel includes a first channel opening at the sleeve first end and a second channel opening at the sleeve second end, the first channel opening in communication with the second channel opening.

In another embodiment, the sleeve channel is adapted to secure the at least one durag tie-end extending through the first channel opening through the second channel opening.

In another embodiment, a distance between the top side and the bottom side is about 2"-3".

In another embodiment, the at least one first releasable attachment mechanism includes at least one of hook and loop material, a snap, a button, a hook, and a zipper.

In another embodiment, the strap first end is releasably attached to the sleeve first end using a second releasable attachment mechanism and/or the strap second end is releasably attached to the sleeve second end using a third releasable attachment mechanism.

In another embodiment, the second releasable attachment mechanism and/or the third releasable attachment mechanism includes at least one of hook and loop material, a snap, a button, and a hook.

In another embodiment, the strap includes a releasable strap break between the strap first end and the strap second end.

In another embodiment, a distance between the sleeve first end and the sleeve second end is about 6"-8".

According to another aspect, one or more embodiments are provided below for an article of headwear for use with a durag, the article of headwear comprising a sleeve including a sleeve left side, a sleeve right side, a sleeve top side, a sleeve bottom side, a sleeve front side, and a sleeve back side, a pad coupled to the sleeve back side, a sleeve channel with a first channel opening at the sleeve left side, a second channel opening at the sleeve right side, and a third channel opening extending across the sleeve top side and/or across the sleeve bottom side and releasably sealed using at least one first releasable attachment mechanism, the first channel opening and the second channel opening defining the sleeve channel extending therebetween, a strap with a strap first end and a strap second end, the strap first end attached to the sleeve left side and the strap second end attached to the sleeve right side, and wherein the sleeve channel is adapted to receive at least one durag tie-end when the article of headwear is placed on a wearer's head.

In another embodiment, the sleeve channel is adapted to receive the at least one durag tie-end through the top side and/or through the bottom side with the at least one durag tie-end passing through the first channel opening and the second channel opening.

In another embodiment, the at least one first releasable attachment mechanism includes at least one of hook and loop material, a snap, a button, a hook, and a zipper.

In another embodiment, the strap first end is releasably attached to the sleeve left side using a second releasable attachment mechanism and/or the strap second end is releasably attached to the sleeve right side using a third releasable attachment mechanism.

In another embodiment, the second releasable attachment mechanism and/or the third releasable attachment mechanism includes at least one of hook and loop material, a snap, a button, and a hook.

In another embodiment, the strap includes a releasable strap break between the strap first end and the strap second end.

In another embodiment, a distance between the top side and the bottom side is about 2"-3".

In another embodiment, a distance between the sleeve left side and the sleeve right side is about 6"-8".

The presently disclosed article of headwear is more fully described in the detailed description below.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the headwear assembly according to exemplary embodiments hereof includes an article of headwear configured to be primarily used in conjunction with a secondary and separate article of headwear. In particular, the headwear assembly is preferably configured to be used with a type of headwear commonly referred to as a durag (also referred to as a wave cap).

Figure 1:
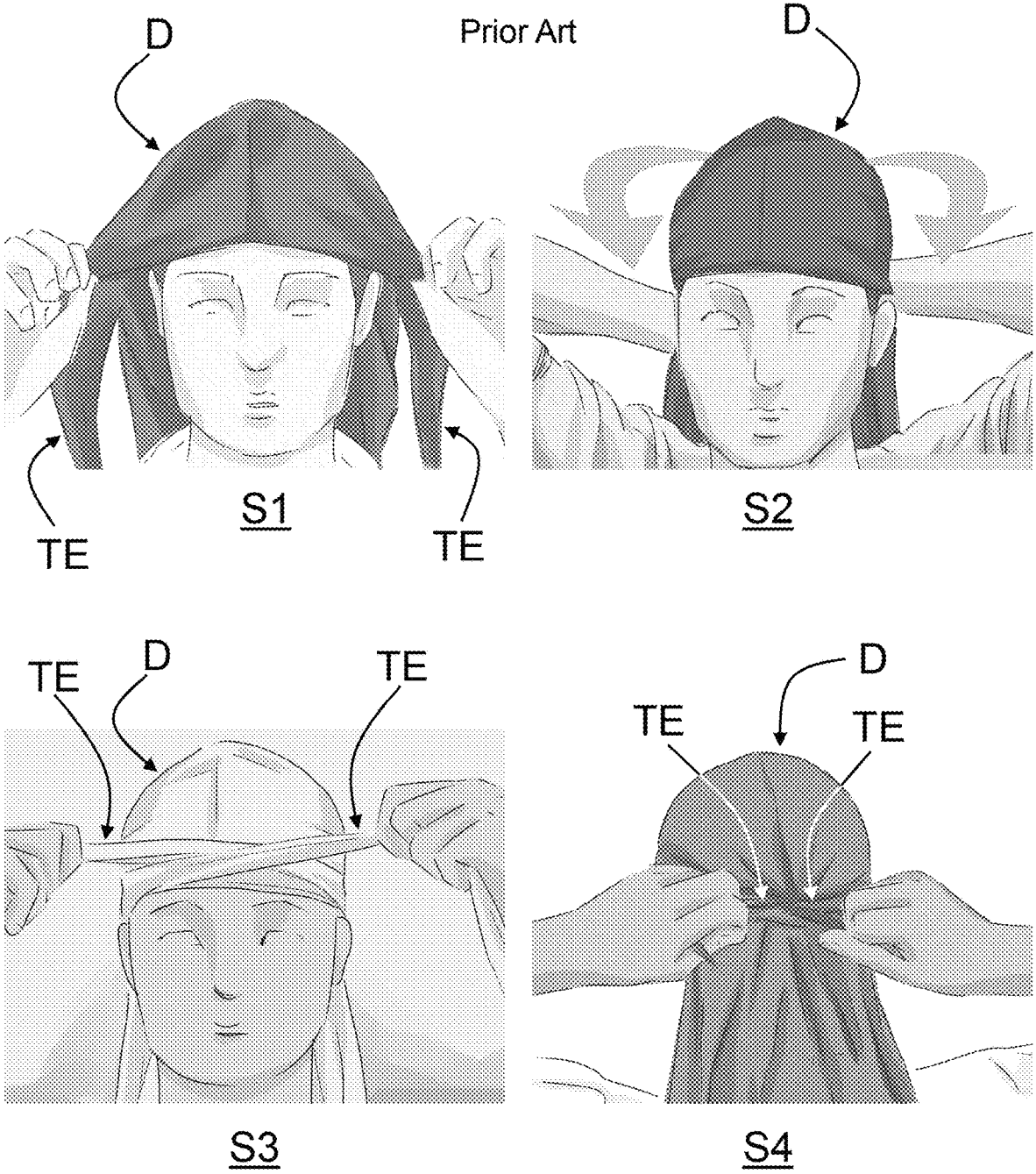
FIG. 1 Prior Art
FIG. 1 shows actions taken to secure a durag to a wearer's head according to exemplary embodiments hereof.

As is known in the art and as depicted in FIG. 1, a durag D is a close-fitting, typically stretchable piece of cloth that is worn on the head (e.g., to hold a hairstyle in place) and that usually includes strings or long tie-ends TE which pass over the forehead and are tied in the back. FIG. 1 depicts four basic steps S1-S4 of tying a durag D onto one's head, including:

S1: Placing the durag D on one's head with the front of the durag D placed over the forehead;

S2: Bringing the left and right tie-ends TE to the rear of the head and crisscrossing them around the back;

S3: Bringing the tie-ends TE to the front of the head and crisscrossing them across the forehead;

S4: Bringing the tie-ends TE to the back of the head a second time and tying them together to hold the durag D in place.

It can be seen that with the durag D tied in place as described, the crisscrossed tie-ends TE across the person's forehead (step S3) may lead to discomfort (e.g., due to pressure against the wearer's forehead) and/or indention marks on the wearer's forehead caused by the ends TE. In addition, the tie-ends TE may often be formed using strings with lesser diameters (compared to the lengths of material otherwise used as the tie-ends) that may further exacerbate these issues. Also, it is not uncommon for a durag to shift position when worn, thereby requiring repositioning and/or re-tying.

To remedy these problems, the headwear assembly according to embodiments hereof provides a padded layer between the durag's tie-ends TE and the wearer's forehead. The headwear also holds the durag and its tie-ends in place when worn. These and other features of the headwear assembly will be described in detail herein.

Figure 2:
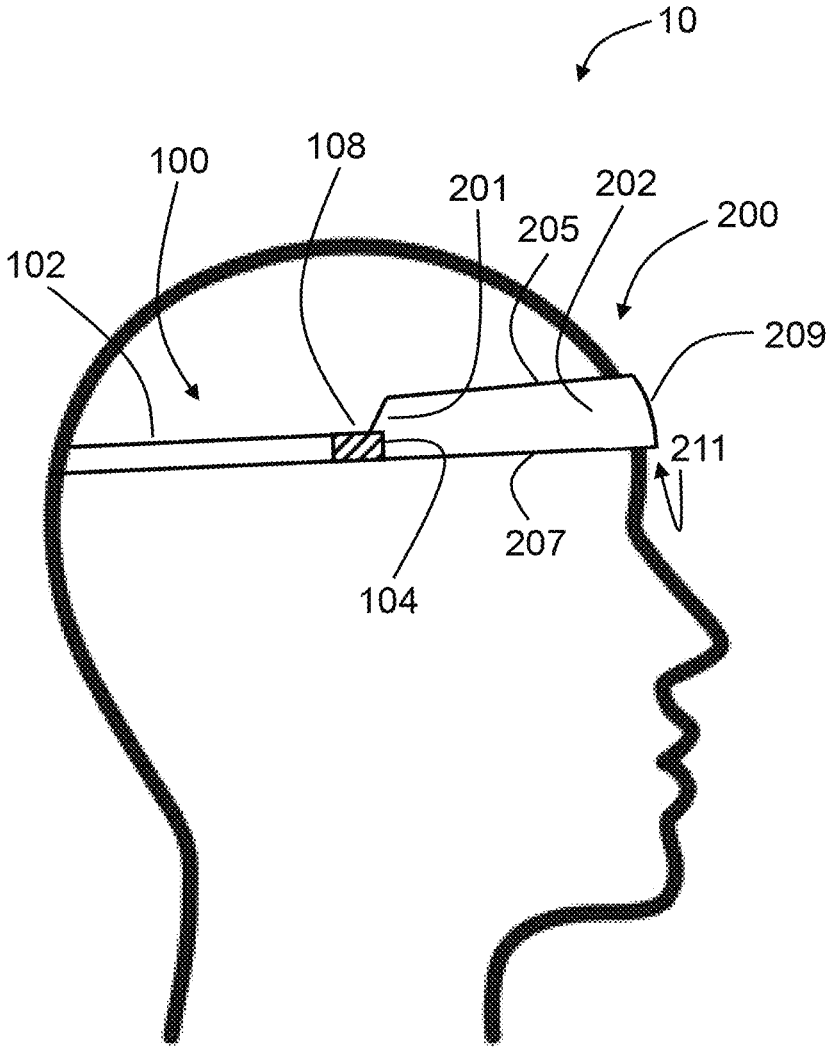
FIG. 2 shows a side view of a headwear assembly being worn according to exemplary embodiments hereof.
Figure 3:
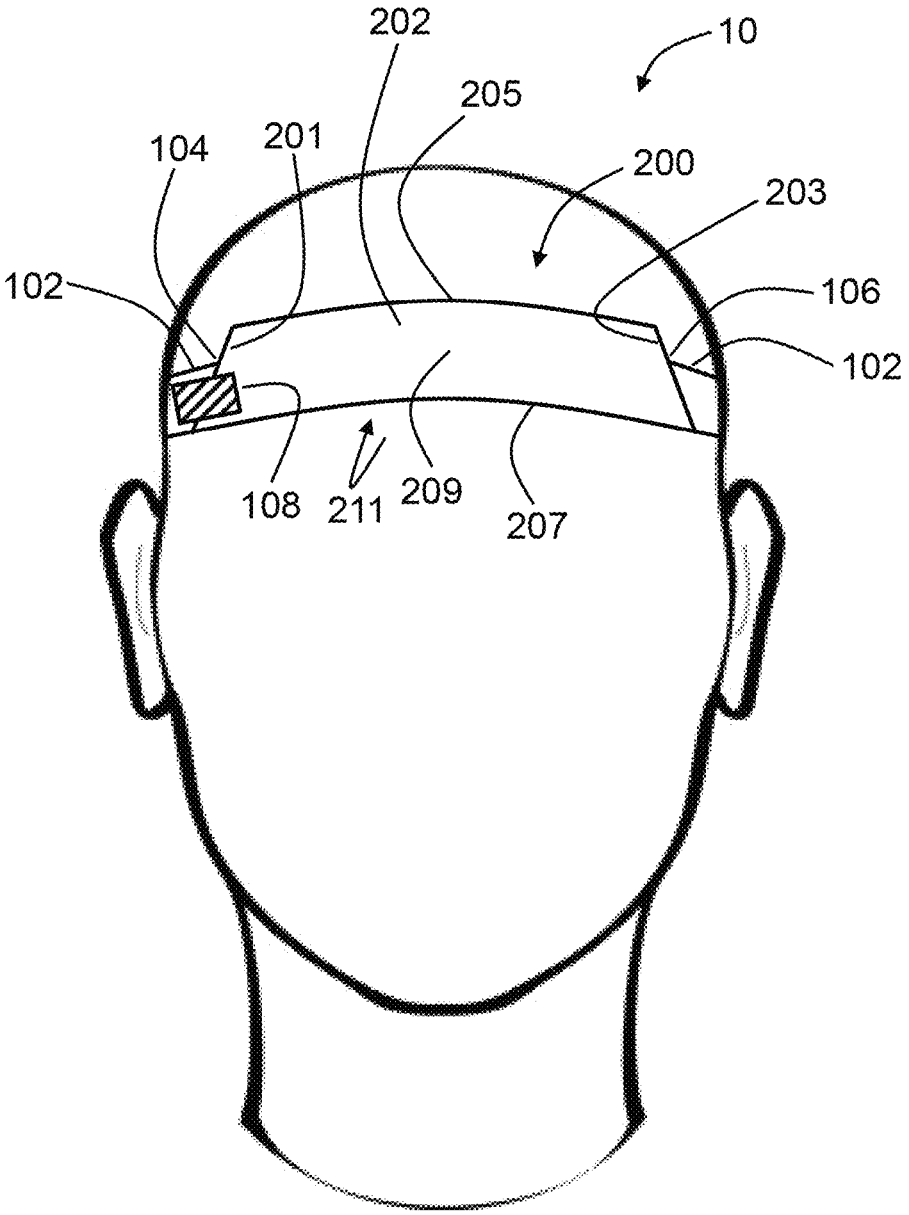
FIG. 3 shows a front view of a headwear assembly being worn according to exemplary embodiments hereof.

In one exemplary embodiment hereof, as shown in FIGS. 2-3, the headwear assembly 10 includes a strap assembly 100 and a pad assembly 200. In general, the strap assembly 100 is formed to secure the headwear assembly 10 to the user's head and the pad assembly 200 is adapted to receive the tie-ends and/or other elements of an associated and separate article of headwear D (e.g., a durag).

Note that the elements 100, 200 are depicted as basic shapes in the figures for easy understanding and to represent the general configuration of the elements 100, 200 with respect to one another. However, it is understood that the representations do not necessarily represent the size, shape or form of the elements 100, 200, nor the proportional sizes, locations and/or exact orientations of the elements 100, 200 with respect to one another. These details will be described in other sections.

In addition, the location of the elements 100, 200 on the wearer's head as depicted may not necessarily represent the exact locations of the elements 100, 200 when worn by different users, and it is understood that the location of the elements 100, 200 during use may depend on the wearer's discretion (e.g., for best comfort). The headwear assembly 10 also may include other components and elements as necessary for the assembly 10 to perform its functionalities.

In some embodiments as shown in FIGS. 2-3, the pad assembly 200 is configured to extend across at least a portion of the wearer's forehead, generally from the left side of the user's forehead to the right side as shown in FIG. 3. The strap assembly 100 is configured to extend from a first side of the pad assembly 200 (e.g., the left side in FIG. 3) around the back of the wearer's head to a second side of the pad assembly 200 (e.g., the right side). In this way, the combination of the strap assembly 100 and the pad assembly 200 may form a continuous band that extends around the entire outer circumference of the wearer's head.

During use, a durag D is placed on the wearer's head (e.g., as shown in FIG. 1, steps 1-2), and prior to performing step 3, the headwear assembly 10 is placed over the durag D with the pad assembly 200 placed over the front of the durag D on the wearer's forehead, and the strap assembly 100 extending over the durag D and around the back of the wearer's head. Next, step 3 of FIG. 1 is performed with the crisscrossing of the durag's tie-ends TE performed on or through (as will be described herein) the front surface of the pad assembly 200 such that the pad assembly 200 provides a layer between the tie-ends TE and the wearer's forehead. As described herein, the layer provided by the pad assembly 200 provides additional support to the durag D and comfort to the wearer.

Strap Assembly 100

In general, and according to some embodiments, the strap assembly 100 as shown in FIG. 1 may be formed to extend around the outer circumference of the user's head (or a portion thereof). In some embodiments, the strap assembly 100 includes a strap 102 with a first end 104 (e.g., a left end) and a second end 106 (e.g., a right end).

The strap 102 may comprise any suitable material such as fabric, string, rope, twine, elastic, plastic, rubber, mesh, webbing, any other suitable material, and any combinations thereof.

In some embodiments as shown in FIGS. 2-3, a first end 104 of the strap 102 (e.g., the left end 104) is attached to a first side 201 of the pad assembly 200 (e.g., the left side 201 as shown in FIG. 2 or 3) and a second end 106 of the strap 102 (e.g., the right end 106 as shown in FIG. 3) is attached to an opposite side 203 of the pad assembly 200 (e.g., the right side 203 as shown in FIG. 3).

In some embodiments, the first end 104 and/or the second end 106 of the strap is releasably attached to a respective side 201, 203 of the pad assembly 200. In this way, at least one end of the strap 102 (e.g., the first end 104 and/or the second end 106) may be released and subsequently reattached from the pad assembly 200 to facilitate putting on and/or taking off the headwear assembly 10.

For example, as shown in FIGS. 2 and 3, the left end 104 of the strap 102 is releasably attached to the left side 201 of the pad assembly 200 using a releasable attachment mechanism 108 such as, without limitation, hook and loop material, snap(s), button(s), latch(es), hook(s), other types of releasable attachment mechanisms, and any combinations thereof. In this case, the right end 106 of the strap 102 may be similarly releasably attached to the right side 203 of the pad assembly, or the right end 106 may be fixedly attached to the right side 203 of the pad assembly 200 (as shown in FIG. 3) using stitching, rivets, adhesive, other types of attachment mechanisms, and any combination thereof.

In other embodiments, both ends 104, 106 of the strap 102 are fixedly attached to respective sides 201, 203 of the pad assembly 200. In this scenario, the strap 102 may comprise elastic and may not require to be released from the pad assembly 200 when putting on and/or removing the headwear assembly 10 from one's head (instead, the strap 102 may stretch and retract).

Figure 4:
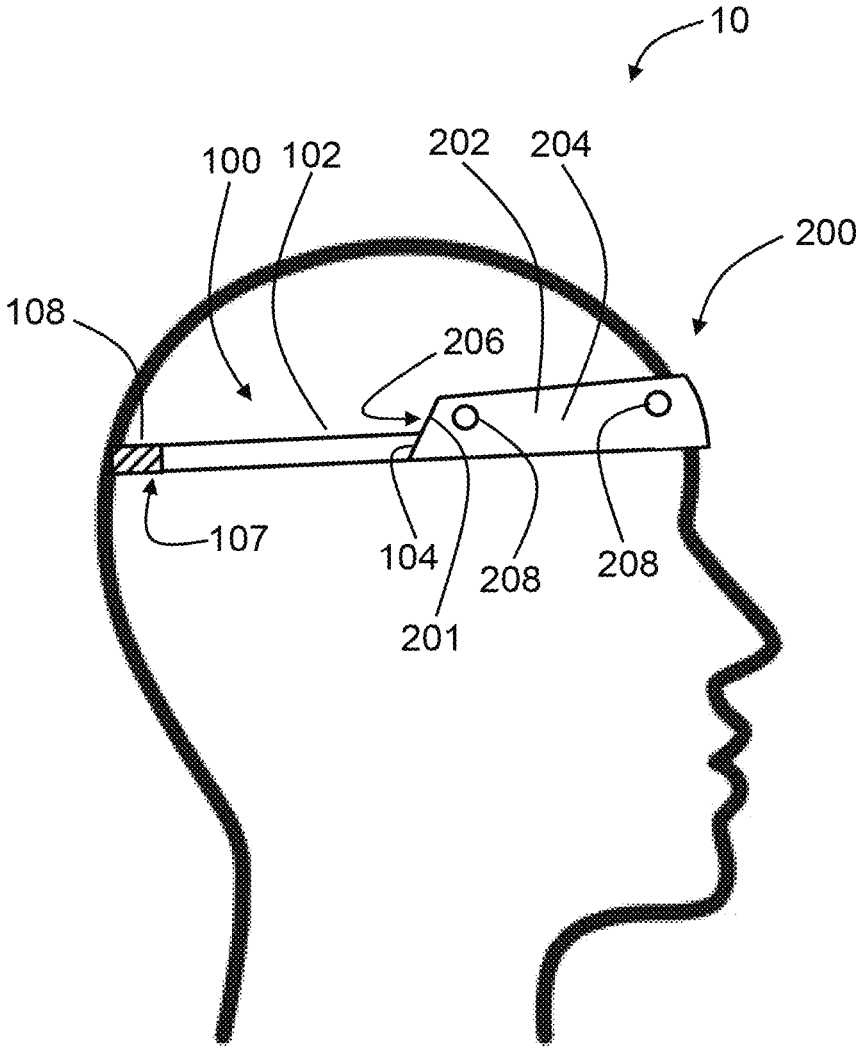
FIG. 4 shows a side view of a headwear assembly being worn according to exemplary embodiments hereof.

In some embodiments as shown in FIG. 4, the strap 102 may include a break 107 configured with a releasable attachment mechanism 108 so that the strap 102 may be opened (by releasing the releasable attachment mechanism 108) and subsequently closed (by securing the releasable attachment mechanism 108) at the break. In this way, the strap 102 may be opened at the break 107 when putting on the headwear assembly 100 and subsequently closed at the break 107 to secure the headwear assembly 10 to the head. While the break 107 and associated releasable attachment mechanism 108 is shown to be generally at the back of the head in FIG. 4, it is understood that the break 107 and the releasable attachment mechanism 108 may be located at any position along the strap 102. It also is understood that the strap 102 may include more than one break 107 and more than one associated releasable attachment mechanism 108.

In some embodiments, the strap 102 is configured to extend around the entire circumference of the wearer's head. In this embodiment, the pad assembly 200, instead of being attached between two ends 104, 106 of the strap 102, may be coupled with of the strap 102 (e.g., coupled to an outer surface of the strap 102) when worn (preferably in the area of the wearer's forehead).

Pad Assembly 200

In some embodiments as shown in FIGS. 2-3, the pad assembly 200 includes a pad 202 adapted to extend across the forehead of the wearer. The pad 202 may be formed in any suitable shape, including, but not limited to, rectangular, oval, trapezoidal, other shapes, and any combinations thereof. In general, the pad 202 includes a pad left side 201, a pad right side 203, a pad top side 205, a pad bottom side 207, a pad front side 209, and a pad back side 211. When the headwear assembly 10 is worn by a wearer as shown in FIG. 3, the pad back side 211 is configured to face the wearer while resting on the wearer's forehead. One general purpose of the pad 202 is to provide a layer of cushion between the durag's tie-ends TE and the wearer's forehead.

In some embodiments, the distance between the pad first side 201 and the pad second side 203 is about 4"-12", and preferably about 5"-10", and more preferably about 6"-8". In some embodiments, the distance between the pad top side 205 and the pad bottom side 207 is about 1"-4", and preferably about 1.5"-3.5", and more preferably about 2"-3".

In some embodiments as shown in FIG. 3, the pad left side 201 is coupled to the strap first end 104 and the pad right side 203 is coupled to the strap second end 106. As described in other sections, the pad left side 201 and the pad right side 203 may be releasably coupled and/or fixedly coupled to the first and second ends 104, 106 of the strap 202, respectively, as desired.

The pad 202 may comprise fabric, foam, rubber, webbing, any other type of suitable material(s), and any combinations thereof. It is preferable that the pad 202 include material(s) that may provide an adequate cushion between the durag's tie-ends TE and the wearer's forehead when worn.

Figure 5:
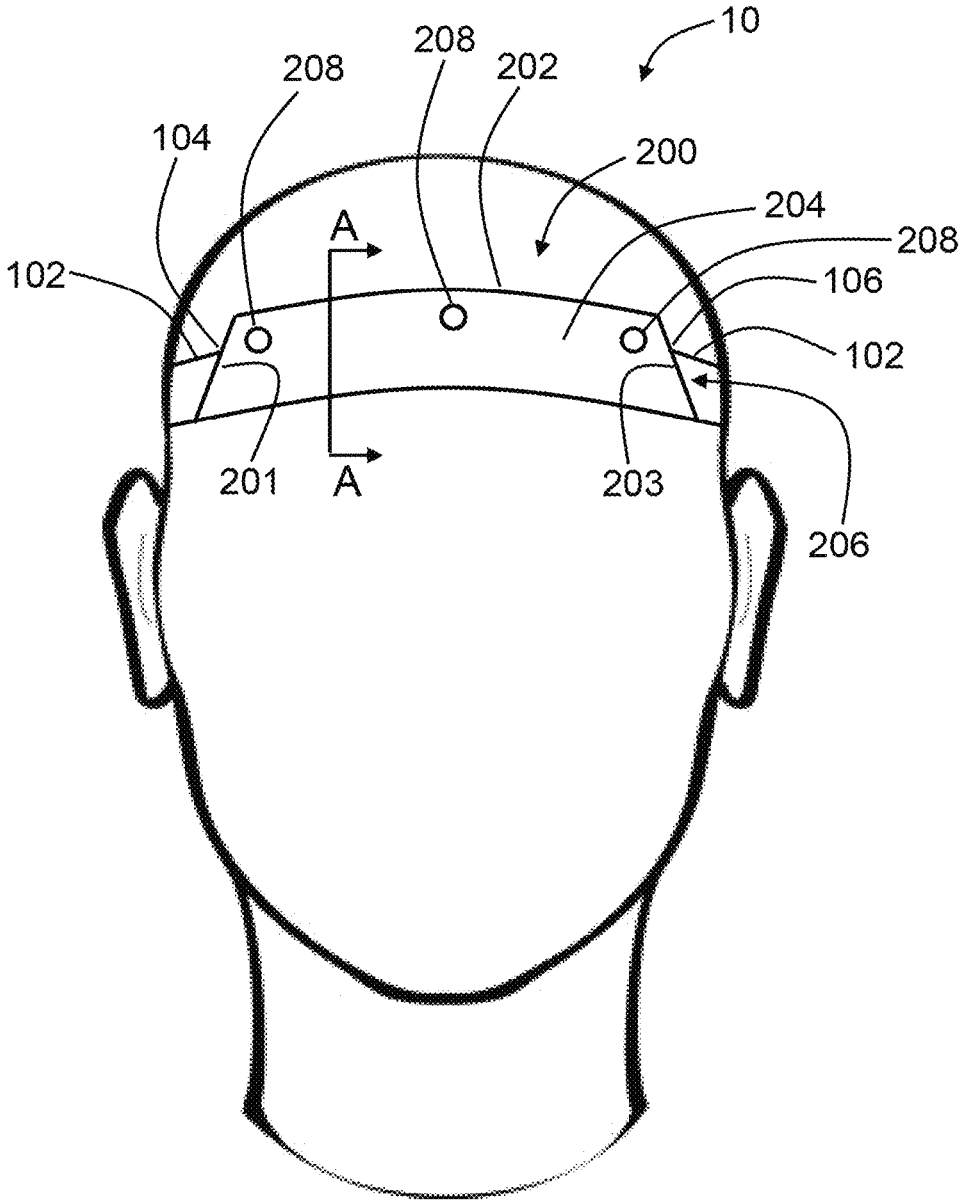
FIG. 5 shows a front view of a headwear assembly being worn according to exemplary embodiments hereof.
Figure 6A:
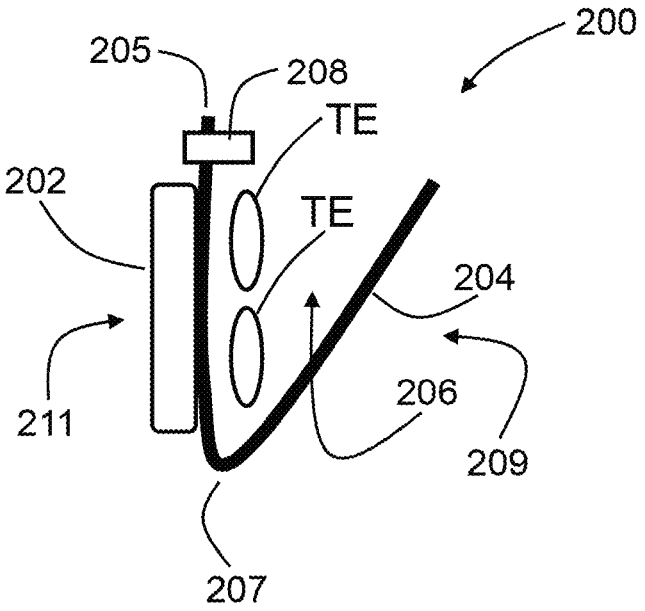
FIGS. 6A-6B show aspects of a pad assembly with a sleeve and channel according to exemplary embodiments hereof.
Figure 6B:
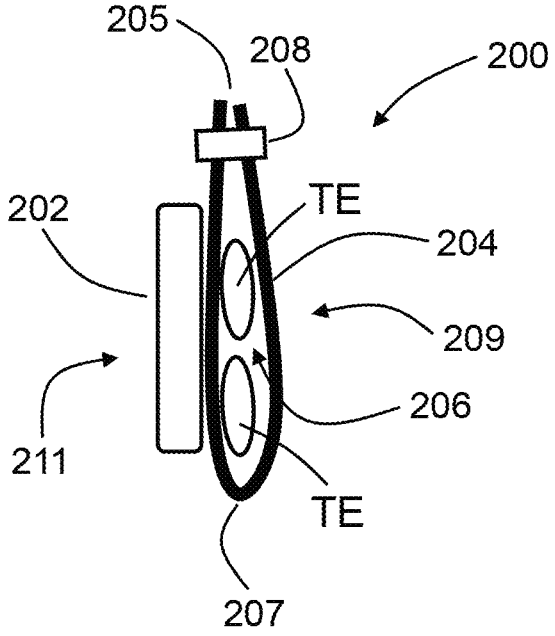

In some embodiments as shown in FIGS. 5 and 6A-6B, the pad assembly 200 includes a sleeve 204 forming a channel 206. FIGS. 6A-6B are taken from the perspective of cutlines A-A in FIG. 5, with FIG. 6A showing the sleeve 204 in an open configuration and FIG. 6B showing the sleeve 204 in a closed configuration. One general purpose of the sleeve 204 is to secure the tie-ends TE of the durag D to the headwear assembly 10 (e.g., within the channel 206) while providing a layer of cushion between the tie-ends TE and the wearer's forehead.

The sleeve 204 may be formed in a variety of ways. For example, in some embodiments as shown in FIGS. 6A-6B, the sleeve 204 includes a portion of material (e.g., fabric) folded over on itself to form the channel 206. The top edges of the folded sleeve 204 may include one or more releasable attachment mechanisms 208 that when closed may close the sleeve 204 (and the channel 206), and when opened may open the sleeve 204 (and the channel 206). Note that while FIGS. 6A-6B depict the sleeve 204 formed from a single piece of material folded over on itself at the bottom, it is understood that the piece of material may be folded over itself at any edge or location (e.g., at the top, the top and the bottom, in the middle, etc.). It also is understood that the sleeve 204 may be formed using two or more pieces of material stitched or otherwise attached together (e.g., at the bottom and/or at the top of the sleeve 204).

In addition, while the pad 202 and the sleeve 204 are shown in FIGS. 6A-6B as two separate elements configured together, the pad 202 and the sleeve 204 may be integrally formed as a single element, such as, without limitation, a padded sleeve 204. In this regard, the sleeve 204 may comprise a material with sufficient padding to provide functionalities of both the pad 202 and the sleeve 204.

FIG. 5 depicts a total of three releasable attachment mechanisms 208 (e.g., as three snaps), however, it is understood that any number of releasable attachment mechanisms 208 may be used. In other embodiments, the releasable attachment mechanism 208 may extend continuously from the left side 201 of the sleeve 206 to the right side 203 of the sleeve 206 (e.g., as a zipper or length of hook and loop material).

It is preferable that the channel 206 generally extend from the left side 201 of the sleeve 204 to the right side 203 of the sleeve 206 (or any portion thereof). In some embodiments as shown in FIGS. 6A and 6B, the channel 206 is adapted to receive a portion of the durag's tie-ends TE that may extend across the wearer's forehead when worn.

In Use

Figure 7:
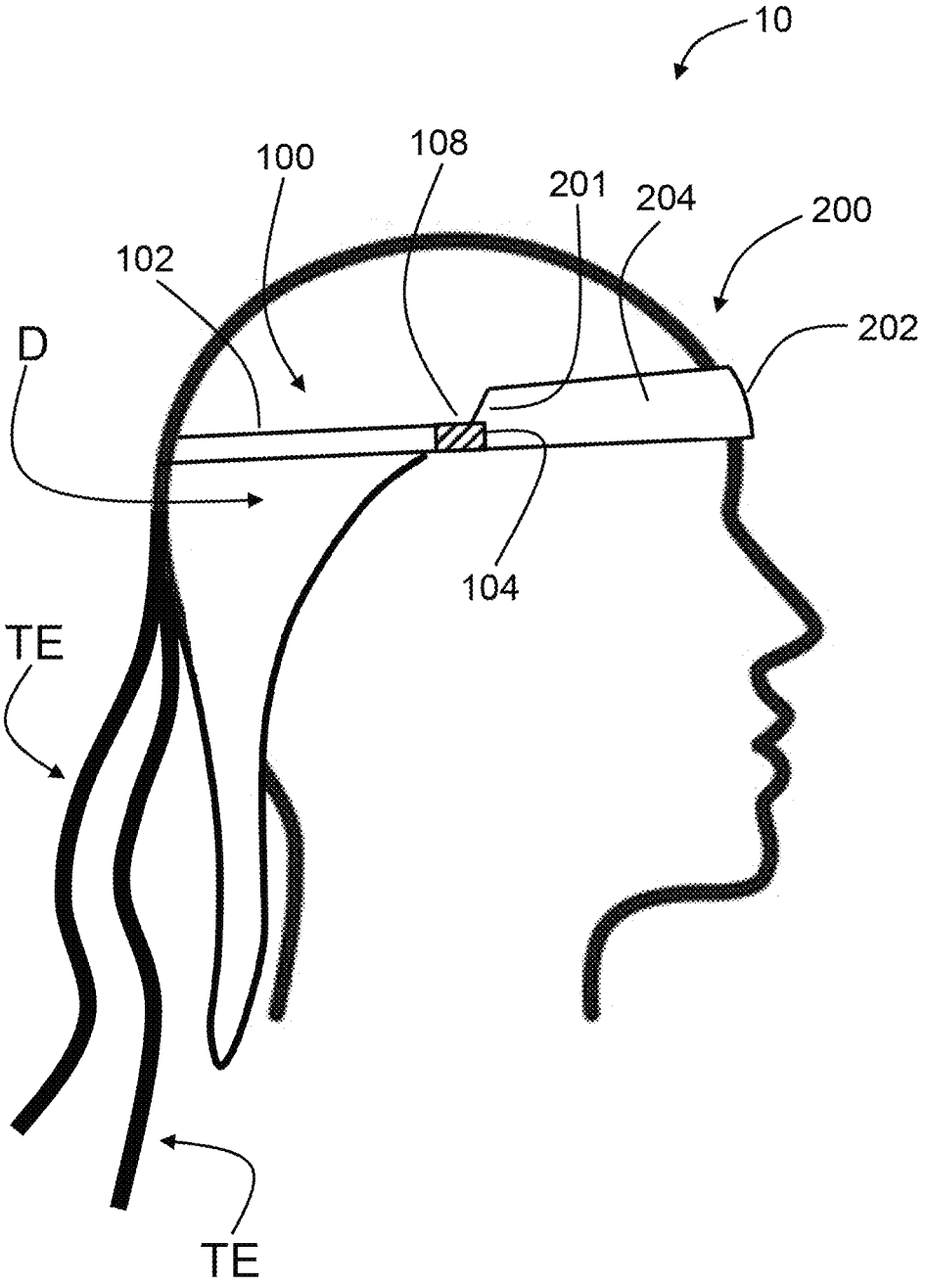
FIG. 7 shows a side view of a headwear assembly when worn during a configuration process with a durag according to exemplary embodiments hereof.

In some embodiments, a durag D is placed on a wearer's head and he tie-ends TE are pulled to the back of the wearer's head (as shown in steps S1 and S2 of FIG. 1). However, prior to performing step S3 of FIG. 1, the headwear assembly 10 is placed over the durag D with the pad 202 and/or the sleeve 204 configured over the front of the durag D in the area of the wearer's forehead. This may result in the configuration shown in FIG. 7.

The headwear assembly 10 may be configured around the circumference of the wearer's head by releasing the releasable attachment mechanism 108, putting the pad 202 and/or sleeve 204 over the forehead, extending the strap 102 around the head and reattaching the releasable attachment mechanism 108 to secure the assembly 10 in place. Alternatively, the headwear assembly 10 may be pulled over the top of the wearer's head and positioned in place.

Figure 8:
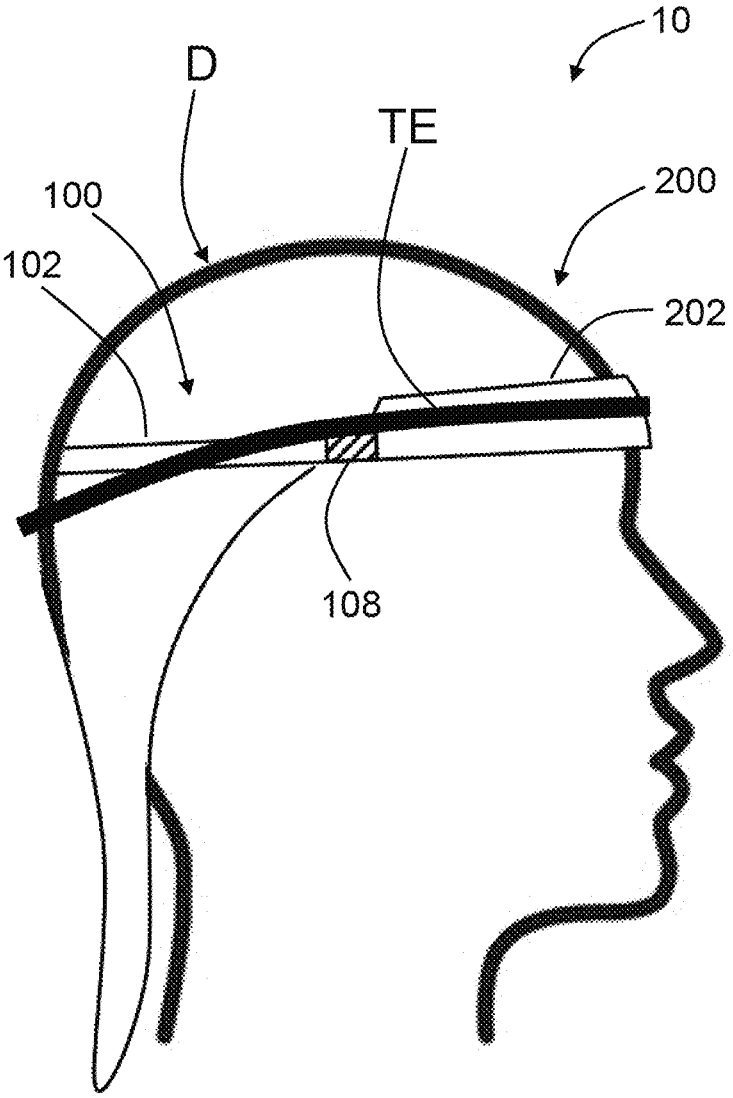
FIG. 8 shows a side view of a headwear assembly when worn and configured with a durag according to exemplary embodiments hereof.

Once the assembly 10 is in place, the tie-ends TE of the durag D may be extended from the back to the front, across the wearer's forehead overtop the pad 202 (crisscrossed if desired but not necessarily) and extended to the back of the wearer's head and tied. This results in the configuration as shown in FIG. 8. In this configuration, the pad 202 provides a cushion between the tie-ends TE and the wearer's forehead.

Figure 9:
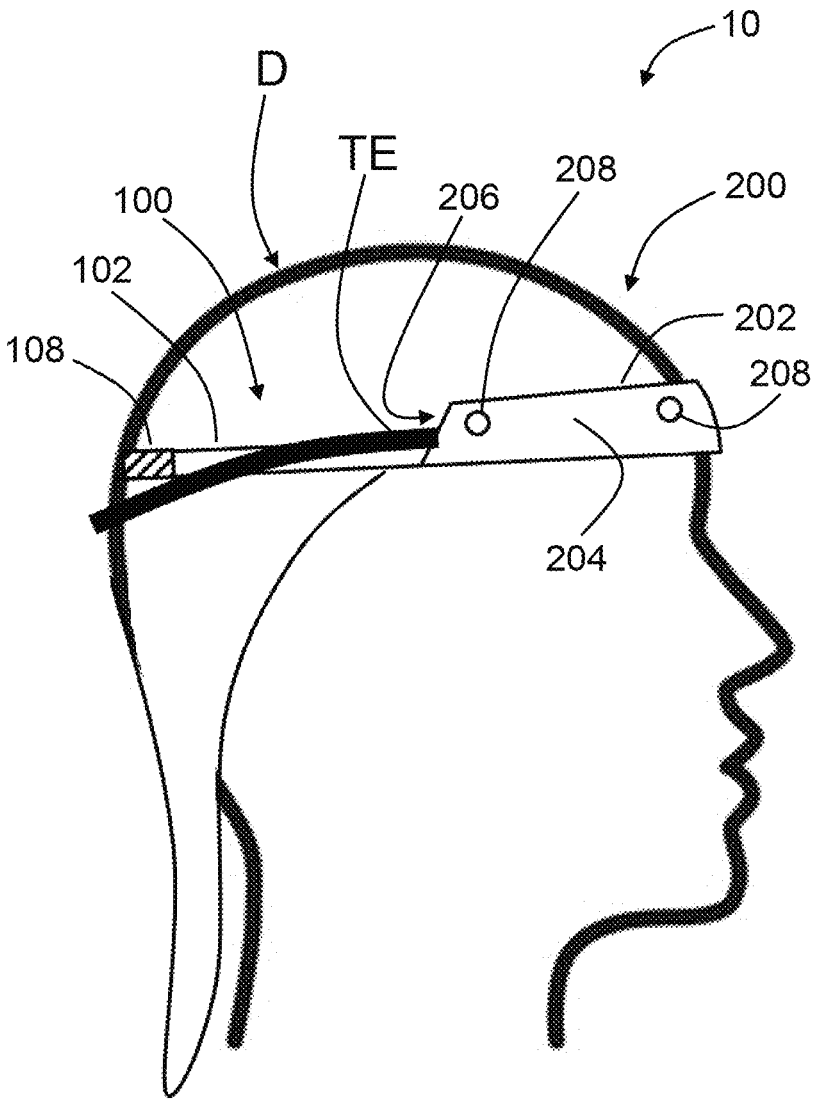
FIG. 9 shows a side view of a headwear assembly when worn and configured with a durag according to exemplary embodiments hereof.

If a sleeve 204 is present as shown in FIG. 9, the sleeve 204 may be opened (by releasing the releasable attachment mechanisms 208 as shown in FIG. 6A) to receive the tie-ends TE into the channel 206, and once received, closed over the tie-ends TE by re-securing the releasable attachment mechanism 208. In this way, the tie-ends TE may be configured within the sleeve's 204's channel 206 as they pass across the wearer's forehead. This configuration provides a cushion between the tie-ends TE and the wearer's forehead and secures the tie-ends TE to the headwear assembly 10 via the sleeve 204. The tie-ends TE may then be extended to the back of the wearer's head and tied.

It is understood that the examples described above are meant for demonstration and that other acts may be performed to configure a headwear assembly 10 with a durag D onto a wearer's head. It also is understood that the scope of the headwear assembly 10 is not limited in any way by the way in which the headwear assembly 10 is placed onto and/or taken off of a wearer's head, or in the way in which the headwear assembly 10 is used in conjunction with a durag D and/or other types of separate headwear.

It is understood that any aspect and/or element of any embodiment of the assembly 10 described herein or otherwise may be combined in any way to form additional embodiments of the assembly 10 all of which are within the scope of the assembly 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. An article of headwear for use with a durag, the article of headwear comprising:

a sleeve with a sleeve first end and a sleeve second end and a sleeve length of about 6"-10" from the sleeve first end to the sleeve second end, the sleeve adapted to extend across a wearer's forehead when worn with the sleeve first end located at a far left side of the wearer's forehead and the sleeve second end located at a far right side of the user's forehead;

a sleeve channel extending between the sleeve first end and the sleeve second end and configured to transition from an open position to a closed position;

a strap with a strap first end and a strap second end, the strap first end attached to the sleeve first end and the strap second end attached to the sleeve second end, the strap extending from the strap first end to the strap second end outside the sleeve channel; and at least one first releasable attachment mechanism configured with the sleeve and adapted to releasably secure the sleeve channel closed when the sleeve channel is in the closed position;

wherein when the article of headwear is placed on a wearer's head in combination with a durag including a first durag tie-end and a second durag tie-end, the sleeve channel is adapted to receive the first durag tie-end into the sleeve first end, through the sleeve channel, and out the sleeve second end, and the second durag tie-end into the sleeve second end, through the sleeve channel, and out the sleeve first end to configure the durag on the wearer's head.

2. The article of headwear of claim 1 wherein the sleeve includes a back side adapted to face the wearer when the article of headwear is placed on the wearer's head, the article of headwear further comprising:

a pad coupled to the back side of the sleeve.

3. The article of headwear of claim 1 wherein the sleeve includes a top side and a bottom side, the top side and the bottom side extending between the sleeve first end and the sleeve second end, and wherein the sleeve channel is configured to open along the top side and/or along the bottom side when transitioning to the open position.

4. The article of headwear of claim 3 wherein the sleeve channel is adapted to receive the first durag tie-end and the second durag tie-end through the top side and/or through the bottom side.

5. The article of headwear of claim 3 where a distance between the top side and the bottom side is about 2"-3".

6. The article of headwear of claim 1 wherein the sleeve channel includes a first channel opening at the sleeve first end and a second channel opening at the sleeve second end, the first channel opening in communication with the second channel opening.

7. The article of headwear of claim 6 wherein the sleeve channel is adapted to secure the first durag tie-end and the second durag tie-end extending through the sleeve channel from the first channel opening to the second channel opening.

8. The article of headwear of claim 1 wherein the at least one first releasable attachment mechanism includes at least one of hook and loop material, a snap, a button, a hook, and a zipper.

9. The article of headwear of claim 1 wherein the strap first end is releasably attached to the sleeve first end using a second releasable attachment mechanism and/or the strap second end is releasably attached to the sleeve second end using a third releasable attachment mechanism.

10. The article of headwear of claim 9 wherein the second releasable attachment mechanism and/or the third releasable attachment mechanism includes at least one of hook and loop material, a snap, a button, and a hook.

11. The article of headwear of claim 1 where a distance between the sleeve first end and the sleeve second end is about 6"-8".

12. An article of headwear for use with a durag, the article of headwear comprising:

a sleeve including a sleeve left side, a sleeve right side, a sleeve top side, a sleeve bottom side, a sleeve front side, a sleeve back side, and a sleeve length of about 6"-10" from the sleeve left side to the sleeve right side, the sleeve adapted to extend across a wearer's forehead when worn with the sleeve left side located at a far left side of the wearer's forehead and the sleeve right side located at a far right side of the user's forehead;

a pad coupled to the sleeve back side;

a sleeve channel with a first channel opening at the sleeve left side, a second channel opening at the sleeve right side, and a third channel opening extending across the sleeve top side and/or across the sleeve bottom side and releasably sealed using at least one first releasable attachment mechanism, the first channel opening and the second channel opening defining the sleeve channel extending therebetween;

a strap with a strap first end and a strap second end, the strap first end attached to the sleeve left side and the strap second end attached to the sleeve right side, the strap extending from the strap first end to the strap second end outside the sleeve channel; and wherein when the article of headwear is placed on a wearer's head in combination with a durag including a first durag tie-end and a second durag tie-end, the sleeve channel is adapted to receive the first durag tie-end into the sleeve first end, through the sleeve channel, and out the sleeve second end, and the second durag tie-end into the sleeve second end, through the sleeve channel, and out the sleeve first end to configure the durag on the wearer's head.

13. The article of headwear of claim 12 wherein the sleeve channel is adapted to receive the first durag tie-end and the second durag tie-end through the top side and/or through the bottom side with the first durag tie-end and the second durag tie-end passing through the first channel opening and through the second channel opening.

14. The article of headwear of claim 12 wherein the at least one first releasable attachment mechanism includes at least one of hook and loop material, a snap, a button, a hook, and a zipper.

15. The article of headwear of claim 12 wherein the strap first end is releasably attached to the sleeve left side using a second releasable attachment mechanism and/or the strap second end is releasably attached to the sleeve right side using a third releasable attachment mechanism.

16. The article of headwear of claim 12 wherein the second releasable attachment mechanism and/or the third releasable attachment mechanism includes at least one of hook and loop material, a snap, a button, and a hook.

17. The article of headwear of claim 12 where a distance between the top side and the bottom side is about 2"-3".

18. The article of headwear of claim 12 wherein a length of the sleeve from the sleeve left side to the sleeve right side is about 6"-8".

* * * * *